US010866545B1

(12) United States Patent
Nozawa et al.

(10) Patent No.: US 10,866,545 B1
(45) Date of Patent: Dec. 15, 2020

(54) FIXING DEVICE HAVING TONER REMOVER AND IMAGE FORMING DEVICE

(71) Applicant: FUJI XEROX Co., Ltd., Tokyo (JP)

(72) Inventors: Narumi Nozawa, Kanagawa (JP); Yasutaka Gotoh, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/720,570

(22) Filed: Dec. 19, 2019

(30) Foreign Application Priority Data

May 20, 2019 (JP) ..... 2019-094542

(51) Int. Cl.
*G03G 15/20* (2006.01)

(52) U.S. Cl.
CPC ..... *G03G 15/2025* (2013.01); *G03G 15/2039* (2013.01); *G03G 2215/00531* (2013.01)

(58) Field of Classification Search
CPC ..... G03G 15/2025; G03G 15/205; G03G 15/5012; G03G 2215/00531; G03G 2215/00708
USPC ..... 399/69, 327
See application file for complete search history.

(56) References Cited

U.S. PATENT DOCUMENTS 3,706,491 A * 12/1972 Furman ..... G03G 15/2025 355/133
4,734,747 A * 3/1988 Okuda ..... G03G 15/553 399/23
6,094,559 A * 7/2000 Otsuka ..... G03G 15/2025 399/327
7,933,543 B2 * 4/2011 Yoshioka ..... G03G 15/6573 399/327
8,805,256 B2 * 8/2014 Shirai ..... G03G 15/2025 399/327
9,727,019 B2 * 8/2017 Tanaka ..... G03G 15/70
2005/0180786 A1 * 8/2005 Yamada ..... G03G 15/2053 399/327
2011/0135325 A1 * 6/2011 Hitaka ..... G03G 15/2039 399/21
2011/0268481 A1 * 11/2011 Tetsuno ..... G03G 15/2025 399/327
2011/0268482 A1 * 11/2011 Akamatsu ..... G03G 15/2025 399/327
2011/0299897 A1 * 12/2011 Onodera ..... G03G 15/2025 399/327

(Continued)

FOREIGN PATENT DOCUMENTS

JP 2001-92292 A 4/2001
JP 2003149979 A * 5/2003

(Continued)

*Primary Examiner* — Robert B Beatty
(74) *Attorney, Agent, or Firm* — Sughrue Mion, PLLC

(57) ABSTRACT

A fixing device includes: a fixer provided with a heater that sandwiches and heats paper transported with a toner image retained thereon, and a remover that removes toner from the heater; and a controller that executes first control with which the paper on which the toner image is retained is fed to the heater in a state where the temperature of the heater has been increased to a first temperature, and second control with which paper on which a toner image is not retained is fed to the heater in a state where the temperature of the heater has been increased to a second temperature that is higher than the first temperature.

12 Claims, 8 Drawing Sheets

(56) References Cited

U.S. PATENT DOCUMENTS

2013/0064583 A1* 3/2013 Yoshida ..... G03G 15/2025
399/327

FOREIGN PATENT DOCUMENTS

JP 2003149985 A * 5/2003
JP 2011095372 A * 5/2011

* cited by examiner

FIXING DEVICE HAVING TONER REMOVER AND IMAGE FORMING DEVICE

CROSS-REFERENCE TO RELATED APPLICATIONS

This application is based on and claims priority under 35 USC 119 from Japanese Patent Application No. 2019-094542 filed May 20, 2019.

BACKGROUND

(i) Technical Field

The present disclosure relates to a fixing device and an image forming device.

(ii) Related Art

There are known fixing devices that are provided with cleaning members. For example, Japanese Unexamined Patent Application Publication No. 2001-92292 discloses a fixing device in which paper onto which a toner image has been transferred is transported between a fixing roller and a pressure roller and is heated and pressed to thereby fix the toner image onto the paper, and toner that has adhered to the pressure roller is cleaned by a cleaning roller. Toner that has spilled onto the fixing roller and pressure roller is sequentially accumulated over time on this cleaning roller. Here, if the fixing roller or the like becomes too hot, the toner may melt and the molten toner may flow backward from the cleaning roller 21 to the pressure roller 13 or fixing roller 12. Japanese Unexamined Patent Application Publication No. 2001-92292 addresses this issue and, to prevent this backward flow, proposes that the image forming operation be stopped for a predetermined time when recording is continuously performed on a predetermined number of sheets of paper, and the fixing roller 12, the pressure roller 13, and the cleaning roller 21 be rotated for a predetermined time to thereby cool down.

SUMMARY

In the case of a configuration in which toner is accumulated on a cleaning roller or the like as in Japanese Unexamined Patent Application Publication No. 2001-92292, there is a limit to the amount of accumulated toner. Therefore, there is a problem in that when that limit is exceeded, toner that has adhered to the fixing roller, the pressure roller, or the like is not recovered to the cleaning roller or the like and adheres to the paper and stains the paper.

Aspects of non-limiting embodiments of the present disclosure relate to a fixing device and an image forming device with which toner stains on paper are suppressed compared to when there is no provision of a mode in which toner is discharged onto paper from a remover that removes toner from a heater.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including:

a fixer provided with a heater that sandwiches and heats paper transported with a toner image retained thereon, and a remover that removes toner from the heater; and a controller that executes first control with which the paper on which the toner image is retained is fed to the heater in a state where the temperature of the heater has been increased to a first temperature, and second control with which paper on which a toner image is not retained is fed to the heater in a state where the temperature of the heater has been increased to a second temperature that is higher than the first temperature.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described.

Figure 1:
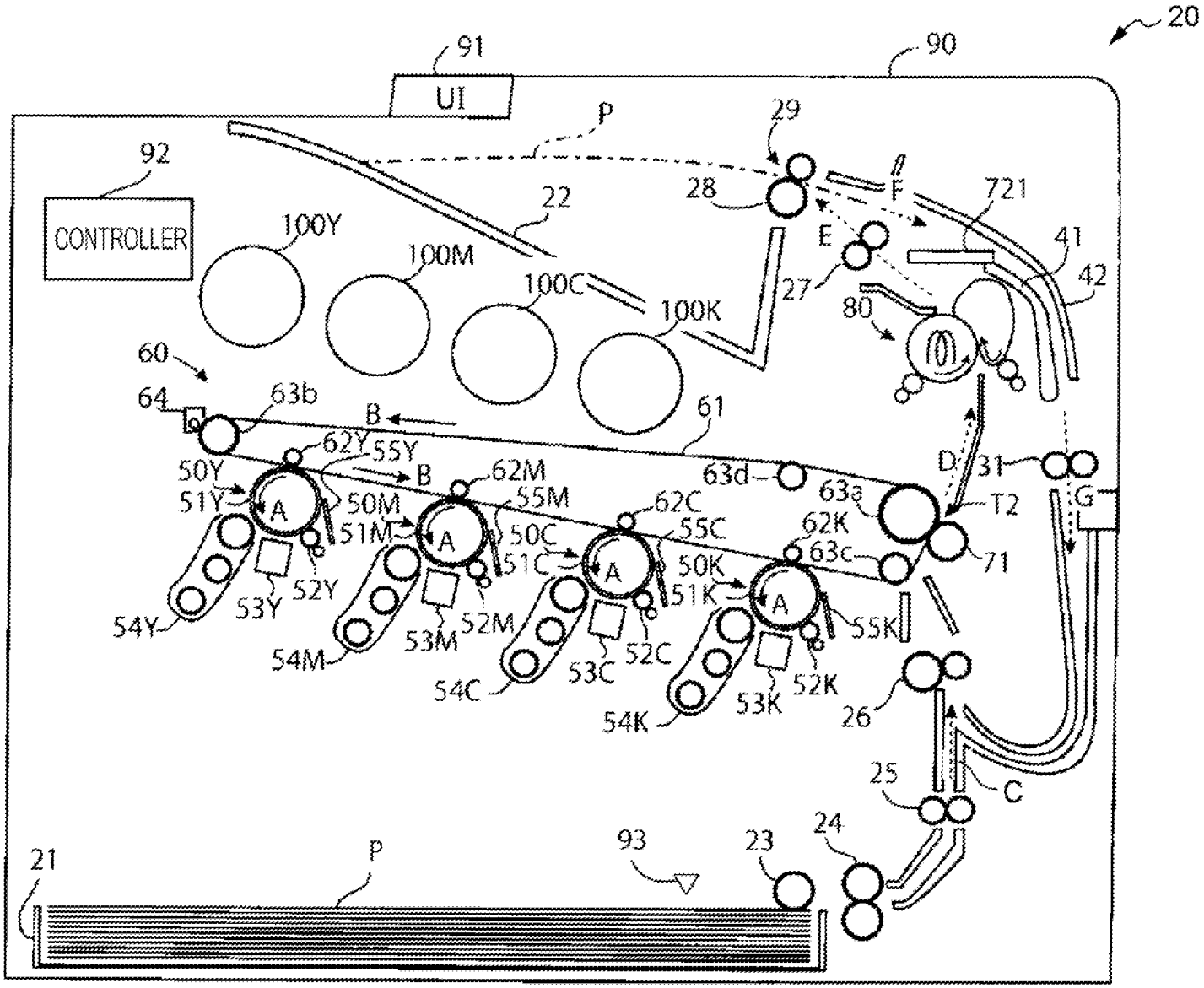
FIG. 1 is a schematic view depicting the internal configuration of a printer serving as an exemplary embodiment of an image forming device of the present disclosure.

FIG. 1 is a schematic view depicting the internal configuration of a printer serving as an exemplary embodiment of an image forming device of the present disclosure. A fixing device serving as an exemplary embodiment of the present disclosure is incorporated into this printer.

This printer 20 has four image formers 50Y, 50M, 50C, and 50K arranged in a single line. In each of these image formers 50Y, 50M, 50C, and 50K, a toner image is formed using respective color toners of yellow (Y), magenta (M), cyan (C), and black (B). Here, for a common description of these image formers 50Y, 50M, 50C, and 50K, these will be referred to as an image former 50 with the reference letters Y, M, C, and K, which represent differentiations in toner color, being omitted. The same is also true for other constituent elements besides the image formers.

Each image former 50 is provided with a photoconductor 51. The photoconductor 51 receives a driving force and rotates in the direction of arrow A. While the photoconductor 51 is rotating, an electrostatic latent image is formed on the surface thereof, and also a toner image is formed due to developing being carried out.

A charging device 52, an exposing device 53, a developing device 54, a primary transfer device 62, and a cleaner 55 are provided around each photoconductor 51 provided in each image former 50. Here, the primary transfer device 62 is arranged in a position where an intermediate transfer belt 61 described later is sandwiched between the primary transfer device 62 and the photoconductor 51. This primary transfer device 62 is an element provided in an intermediate transfer unit 60 described later.

The charging device 52 charges the surface of the photoconductor 51 in a uniform manner.

The exposing device 53 radiates exposure light which is modulated based on an image signal, onto the uniformly charged photoconductor 51, for an electrostatic latent image to be formed on the photoconductor 51.

The developing device 54 develops the electrostatic latent image formed on the photoconductor 51, using a toner of the color corresponding to the respective image former 50, and forms a toner image of the respective color on the photoconductor 51.

The primary transfer device 62 transfers the toner image formed on the photoconductor 51, to the intermediate transfer belt 61 described later.

The cleaner 55 removes toner and the like remaining on the photoconductor 51 after transfer, from the photoconductor 51.

The intermediate transfer unit 60 is arranged above the four image formers 50. Also, the intermediate transfer unit 60 is provided with the intermediate transfer belt 61. The intermediate transfer belt 61 is supported by multiple rollers such as a driving roller 63*a*, a driven roller 63*b*, and stretching rollers 63*c* and 63*d*. The intermediate transfer belt 61 is then driven by the driving roller 63*a* and moves circularly in the direction of arrow B on a circulation path that includes a path along the four photoconductors 51 provided in the four image formers 50.

The toner images on the photoconductors 51 are transferred so as to be sequentially superposed on the intermediate transfer belt 61 due to the action of the primary transfer device 62. The toner images transferred onto the intermediate transfer belt 61 are then transported to a secondary transfer position T2 by the intermediate transfer belt 61. A secondary transfer device 71 is provided in the secondary transfer position T2, and the toner images on the intermediate transfer belt 61 are transferred onto paper P that has been transported to the secondary transfer position T2, due to the action of the secondary transfer device 71. The transporting of the paper P will be described later. Toner or the like remaining on the intermediate transfer belt 61 after transfer of the toner images onto the paper P is removed from the intermediate transfer belt 61 by a cleaner 64.

Toner cartridges 100 that house toner of each color are provided above the intermediate transfer unit 60. When the toner inside the developing device 54 has been used up due to developing being carried out, the developing device 54 is replenished with toner through a toner replenishment path that is not depicted, from the toner cartridge 100 that houses toner of the corresponding color. The toner cartridges 100 are configured to be detachable with respect to a device housing 90, and, when empty, are taken out and new toner cartridges 100 are mounted.

Furthermore, this printer 20 is provided with a UI (user interface) 91. The UI 91 is configured from a touch-panel display screen, push buttons, or the like, transmits user instructions to the printer 20, and displays messages for the user from the printer 20.

In addition, the printer 20 is provided with a controller 92. The controller 92 controls each part of the printer 20, including control that is characteristic to the present exemplary embodiment which will be described later.

A paper tray 21 is provided with an empty state detection sensor 93. The empty state detection sensor 93 detects that the paper tray 21 is empty when the paper P housed in the paper tray 21 has been used up.

When an image is to be formed on the paper P, one sheet of the paper P is retrieved from the paper tray 21 by a pickup roller 23 and separated to only one sheet by handling rollers 24, and the one sheet of separated paper P is transported by transport rollers 25 to timing adjustment rollers 26 on a transport path in the direction of arrow C. The paper P transported to the timing adjustment rollers 26 is fed to the secondary transfer position by the timing adjustment rollers 26 so as to reach the secondary transfer position T2 in accordance with the timing at which the toner images on the intermediate transfer belt 61 reach the secondary transfer position T2. The paper P fed by the timing adjustment rollers 26 receives the transfer of toner images from the intermediate transfer belt 61 due to the action of the secondary transfer device 71, at the secondary transfer position T2. The paper P having received the transfer of toner images is further transported in the direction of arrow D and passes through a fixing device 80. The toner images on the paper P have heat and pressure applied thereto by the fixing device 80 and are fixed onto the paper P. Thus, an image composed of the fixed toner images is printed on the paper P. The paper to which toner images have been fixed by the fixing device 80 is further transported in the direction of arrow E by transport rollers 27, and is fed to a paper output tray 22 from a paper output opening 29 by paper output rollers 28. The fixing device 80 corresponds to an example of a fixing device of the present disclosure. Details of the fixing device 80 will be described later.

The printer 20 has the function of printing images on both sides of the paper. When images are to be printed on both sides of the paper, first, an image is printed on a first side of the paper in a manner similar to that mentioned above, and the paper is output to a midway position indicated by a one-dot chain line in FIG. 1 above the paper output tray 22. Then, at the stage at which the paper has been output to the midway position, the paper output rollers 28 rotate in reverse. In doing so, the paper this time advances in the direction of arrow F, passes along a reverse transport path sandwiched between two guiding members 41 and 42, is further transported in the direction of arrow G by the transport rollers 31, and once again reaches the timing adjustment rollers 26. The paper is then fed to the secondary transfer position so as to reach the secondary transfer position T2 in accordance with the timing at which toner images for a second side, on the intermediate transfer belt 61, reach the secondary transfer position T2. At the secondary transfer position T2, the toner images are transferred onto the second side of the paper, the paper after the transfer is transported in the direction of arrow D and fixed by the fixing device 80, further transported in the direction of arrow E, and this time output onto the paper output tray 22 by the paper output rollers 28. Images are printed onto both sides of the paper that is output onto the paper output tray 22.

Here, the structure of the fixing device 80 will be described.

Figure 2:
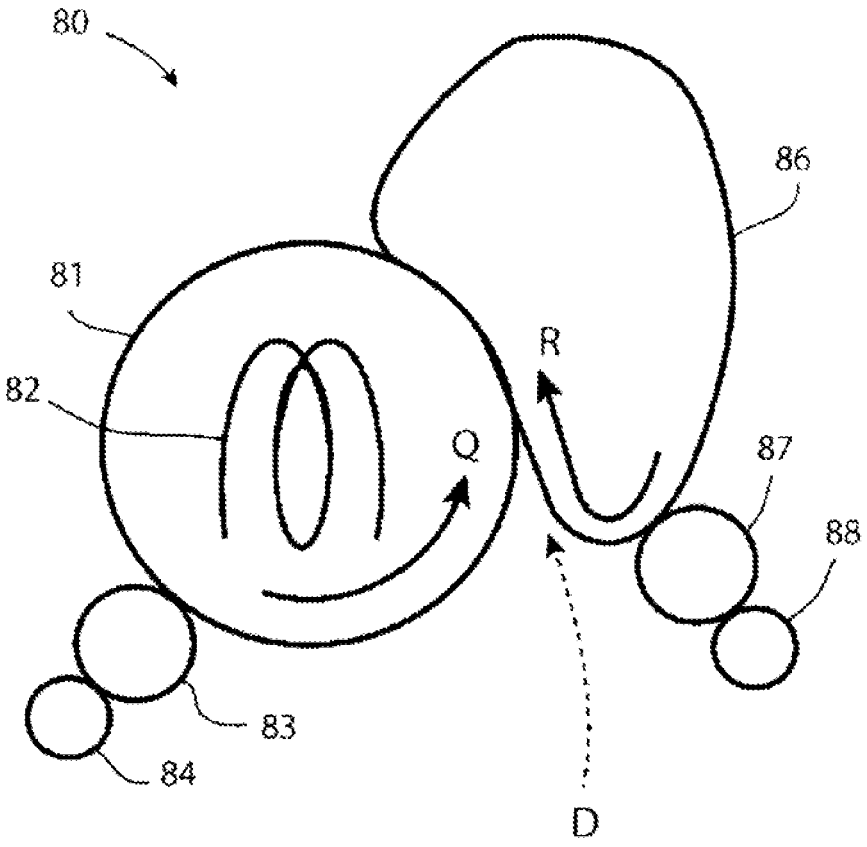
FIG. 2 is an enlarged schematic view of a fixing device provided in the printer in FIG. 1.

FIG. 2 is an enlarged schematic view of the fixing device provided in the printer in FIG. 1.

The fixing device 80 is provided with a heating roller 81 and a pressure belt 86. A halogen lamp 82 for heating is housed within the heating roller 81. The pressure belt 86 is pressed against the heating roller 81 by an undepicted mechanism, and the heating roller 81 and the pressure belt 86 then rotate or move circularly in the directions of arrows Q and R respectively.

The paper P having received the transfer of toner images at the secondary transfer position T2 depicted in FIG. 1 is transported in the direction of arrow D, is sandwiched between the heating roller 81 and the pressure belt 86, and is heated and pressured, and the toner images on the paper P are fixed to the paper P. During the fixing, toner may spill from the edges of the paper P in particular, and the spilled toner may adhere to the heating roller 81 and the pressure belt 86. If toner is left adhered to the heating roller 81 and the pressure belt 86, that toner may adhere to the next sheet of paper P and stain that paper P.

Thus, the fixing device 80 of this exemplary embodiment is provided with a configuration that suppresses stains on paper caused by spilled toner. In other words, the fixing device 80 is provided with: a cleaning roller 83 that removes, from the heating roller 81, toner that has adhered to the heating roller 81; and a support roller 84 that receives and accumulates toner from the cleaning roller 83. Furthermore, similarly, the fixing device 80 is provided with: a cleaning roller 87 that removes, from the pressure belt 86, toner that has adhered to the pressure belt 86; and a support roller 88 that receives and accumulates toner from the cleaning roller 87.

Here, the pair of the heating roller 81 and the pressure belt 86 correspond to an example of a heater in the present disclosure. Furthermore, the heating roller 81 corresponds to an example of a first rotating body in the present disclosure, and the pressure belt 86 corresponds to an example of a second rotating body in the present disclosure. Furthermore, the pair of the cleaning roller 83 and the support roller 84, and the pair of the cleaning roller 87 and the support roller 88 each correspond to an example of a remover in the present disclosure. In addition, the cleaning roller 83 corresponds to an example of a first cleaner in the present disclosure, and the cleaning roller 87 corresponds to an example of a second cleaner in the present disclosure. In addition, the support roller 84 corresponds to an example of a first accumulator in the present disclosure, and the support roller 88 corresponds to an example of a second accumulator in the present disclosure.

Figure 3A:
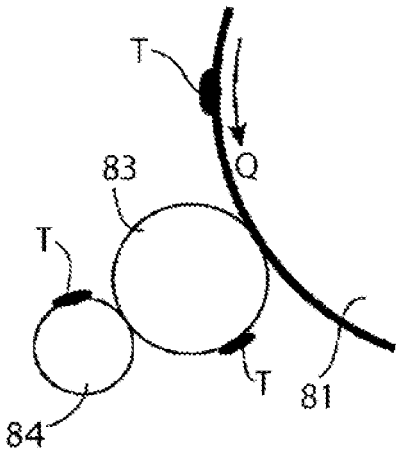
FIGS. 3A to 3C are explanatory diagrams of the action of a cleaning roller and a support roller.
Figure 3B:
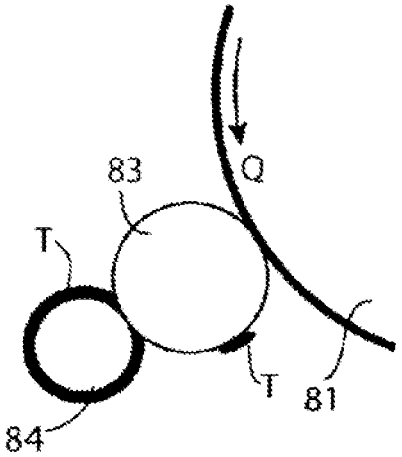
Figure 3C:
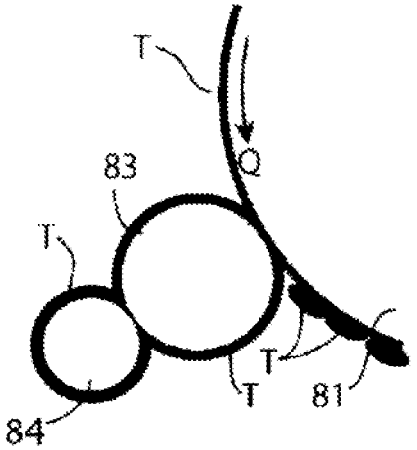

FIGS. 3A to C are explanatory diagrams of the action of a cleaning roller and a support roller. FIGS. 3A to C depict the heating roller 81 and the cleaning roller 83 and support roller 84 near the heating roller 81; however, the description given hereinafter is also true for the cleaning roller 87 and support roller 88 near the pressure belt 86.

FIGS. 3A to C depict the heating roller 81, the cleaning roller 83 and the support roller 84. When the adhesion of the heating roller 81, the cleaning roller 83, and the support roller 84 with respect to the toner T is expressed as Fhr, Fcln, and Fspt respectively, the surface properties of each roller 81, 82, and 83 are adjusted so that is the expression below is established. Fhr<Fcln<Fspt The toner adheres more readily as the value for this adhesion increases. A method for measuring adhesion will be described later with reference to FIG. 4.

FIG. 3A depicts a state where toner has mostly not yet accumulated on the support roller.

In this case, toner T that has spilled onto the heating roller 81 is recovered to the cleaning roller 83, further transitions to the support roller 84, and is accumulated on the support roller 84.

FIG. 3B depicts a state where the amount of accumulated toner T on the support roller 84 is almost at the maximum.

Even in this state, the toner T on the heating roller 81 is recovered to the cleaning roller 83 when there is still room for more toner T on the cleaning roller 83. However, the support roller is full, and therefore the toner T that has been recovered is accumulated on the cleaning roller 83.

FIG. 3C depicts a state where the accumulation has progressed further and the cleaning roller 83 is also full.

When not only the support roller 84 but also the cleaning roller 83 is full, the toner T on the heating roller 81 is no longer recovered and remains on the heating roller 81. In this state, there is a risk of the toner T on the heating roller 81 adhering to the paper P that is next transported to the fixing device 80 and that paper P being stained.

Particularly in a case where countermeasures are not taken, reaching the state in FIG. 3C constitutes reaching the lifespans of the cleaning roller 83 and the support roller 84, and it becomes necessary for an operator to remove and clean or replace the cleaning roller 83 and the support roller 84. The present exemplary embodiment is characterized in that when the cleaning roller 83 and the support roller 84 have reached the state in FIG. 3C, the cleaning roller 83 and the support roller 84 are regenerated to a state close to that in FIG. 3A without being removed.

Figure 4:
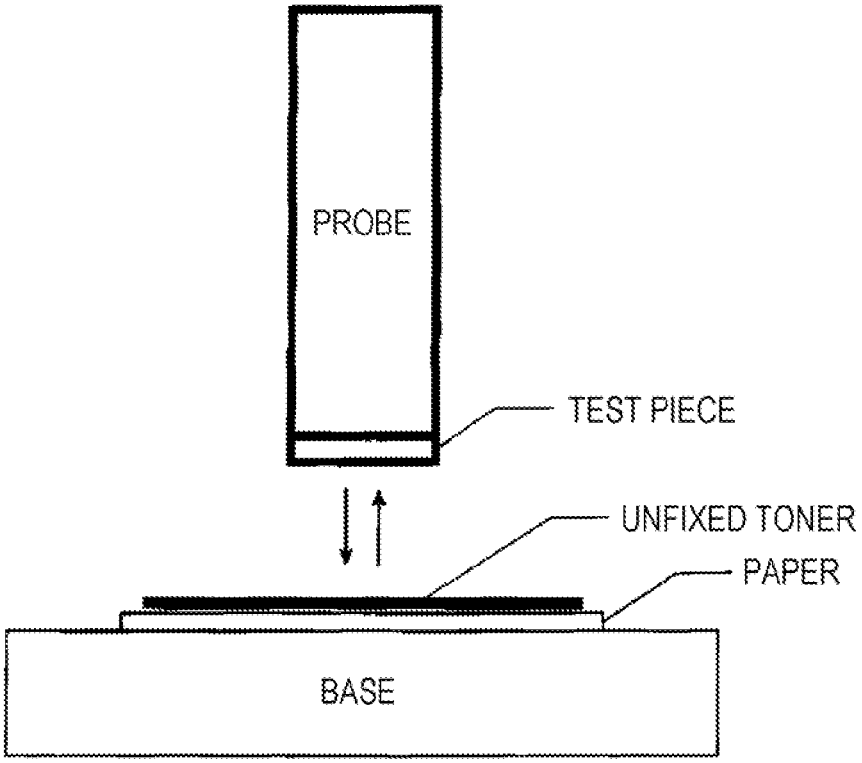
FIG. 4 is an explanatory diagram of a method for measuring adhesion and toner cohesion.

FIG. 4 is an explanatory diagram of a method for measuring adhesion and toner cohesion.

Paper is placed on a base, and unfixed toner is placed on the paper. Meanwhile, a test piece is arranged on the tip end of a probe. In this state, the probe is lowered, the test piece is pressed against the unfixed toner, and the probe is then pulled up. The pressing force, pressing time, and temperature are taken as the design values for the rollers. Also, the force required to pull away the test piece after the toner has been melted is measured in these conditions. The force required to pull away the test piece constitutes the adhesion (kPa) of the toner with respect to the test piece.

Furthermore, it is also possible to investigate the cohesion (kPa) of the toner using this test method. Paper is used as the test piece to investigate the cohesion of the toner. This is carried out at various temperatures. The toner softens when a high temperature is reached, and melts when an even higher temperature is reached. The cohesion of the toner thereby decreases greatly. In the present exemplary embodiment, the point that the cohesion of the toner decreases greatly when melted at a high temperature is used for the cleaning roller 83 and the support roller 84 to be regenerated.

Figure 5A:
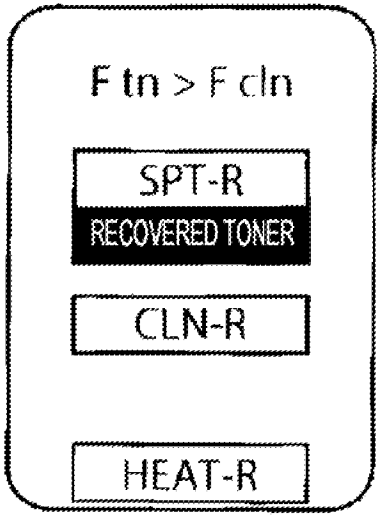
FIGS. 5A to 5C are explanatory diagrams depicting the behavior, at a high temperature, of toner that has accumulated on the support roller.
Figure 5B:
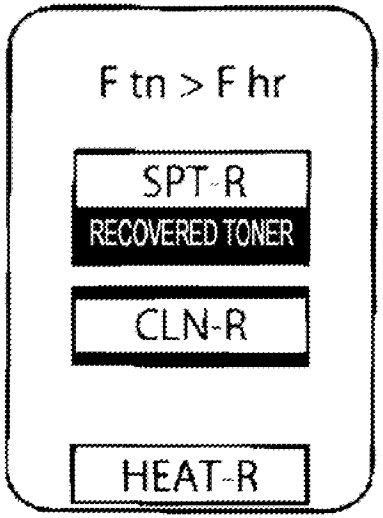
Figure 5C:
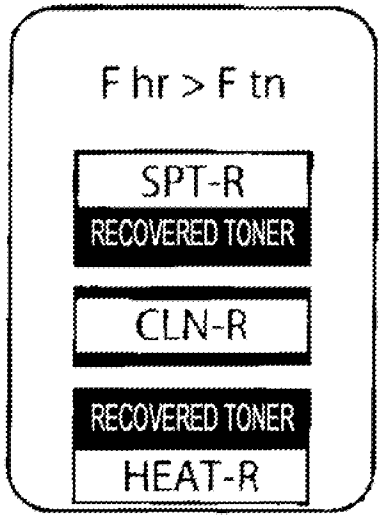

FIGS. 5A to C are explanatory diagrams depicting the behavior, at a high temperature, of toner that has accumulated on the support roller.

Here, the cohesion of the toner is expressed as Ftn, in addition to the adhesion Fhr of the heating roller 81, the adhesion Fcln of the cleaning roller 83, and the adhesion Fspt of the support roller 84.

FIG. 5A depicts a normal state where toner recovered from the heating roller is accumulated on the support roller. At such time, the cohesion Ftn of the toner exceeds the adhesion Fcln of the cleaning roller.

FIG. 5B depicts a state where the temperature is higher compared to the state in FIG. 5A and the cohesion Ftn of the toner has decreased. However, in FIG. 5B, the cohesion Ftn of the toner still exceeds the adhesion Fhr of the heating roller (Ftn>Fcln). At such time, the toner accumulated on the support roller also transfers to the cleaning roller. However, at this point, the toner has not yet transferred to the heating roller.

FIG. 5C depicts a state where the temperature is even higher compared to the state in FIG. 5B and the cohesion Ftn of the toner has dropped below the adhesion Fhr of the heating roller (Ftn<Fhr). When the toner has a high temperature and Ftn<Fhr, the toner originally accumulated on the support roller adheres not only to the cleaning roller but also to the heating roller.

In the present exemplary embodiment, the state in FIG. 5C is produced and then paper is fed and toner that has adhered to the heating roller is made to adhere to the paper. As a result, the amount of toner that accumulates on the cleaning roller and the support roller is reduced, thereby regenerating the capability to recover toner on the heating roller.

Figure 6:
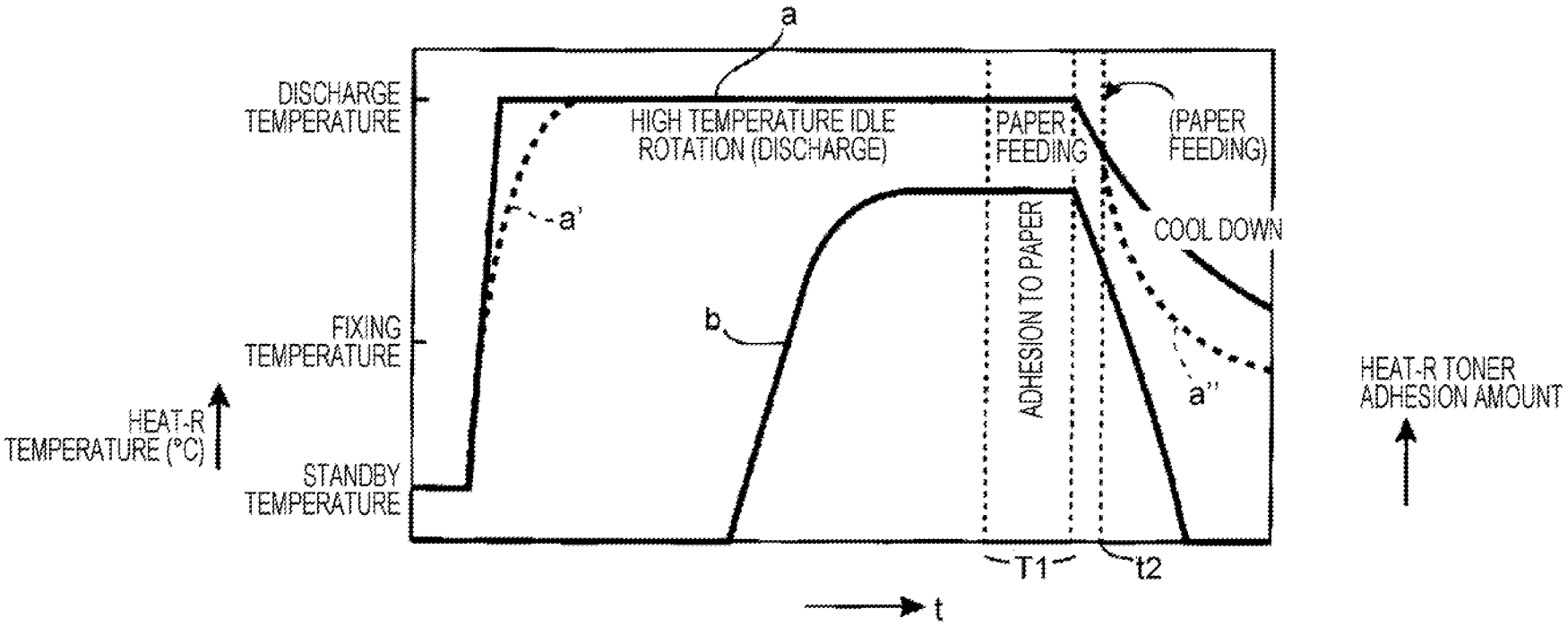
FIG. 6 is a drawing depicting changes over time in the temperature of a heating roller in a discharge mode and the amount of toner transferred onto the heating roller.

FIG. 6 is a drawing depicting changes over time in the temperature of the heating roller in a discharge mode and the amount of toner transferred onto the heating roller. Here, in the discharge mode, a sequence is executed in which toner that has accumulated on the support roller and the cleaning roller is transferred to the heating roller and made to adhere to paper.

Line a in FIG. 6 indicates temperature changes of the heating roller. The heating roller is maintained at a standby temperature when in a standby state. Then, when normal image forming is carried out, the temperature of the heating roller, which is at that standby temperature, is increased to a fixing temperature for the fixing operation to be executed. Control that causes this normal fixing operation to be executed, carried out by the controller 92 depicted in FIG. 1, corresponds to an example of first control and third control in the present disclosure. Furthermore, the fixing temperature corresponds to an example of a first temperature in the present disclosure. Furthermore, control that causes the discharge mode described hereinafter to be executed, carried out by the controller 92 depicted in FIG. 1, corresponds to an example of second control in the present disclosure.

In this discharge mode, the heating roller is heated to a discharge temperature that is higher than the fixing temperature. This discharge temperature corresponds to an example of a second temperature in the present disclosure. When the heating roller at the standby temperature is heated up to the discharge temperature, if the amount of heat applied per unit time is just sufficient to eventually reach the discharge temperature (an example of a second amount of heat in the present disclosure), it takes a while for the heating roller to reach the discharge temperature as indicated by the dashed line a' in FIG. 6. Thus, here, when the temperature of the heating roller at the standby temperature is started to be increased, an amount of heat (a first amount of heat in the present disclosure) is imparted that is sufficient to reach a temperature (a third temperature in the present disclosure) that is even higher than the discharge temperature if continually imparted, and midway, the amount of heat imparted is switched to an amount of heat (the second amount of heat) that is sufficient to eventually reach the discharge temperature. By doing so, the temperature of the heating roller may be increased rapidly to the discharge temperature as indicated by line a, and the time to completing the discharge mode may be shortened.

The heating roller, after reaching the discharge temperature, is maintained at the discharge temperature for some time. Line b indicates the amount of toner that has adhered to the heating roller. If the heating roller is maintained at the discharge temperature for some time, the state in FIG. 5C is entered, in which heat from the heating roller is transmitted to the cleaning roller and support roller, and the toner melts and adheres to the heating roller.

During time T1 in this state, paper P is retrieved from the paper tray 21 (see FIG. 1), toner images are not formed, and paper having no toner images thereon is passed through the fixing device 80. In doing so, toner that has adhered to the heating roller transfers to the paper. Here, a plurality of sheets (five sheets, for example) of paper are passed through. When image forming is carried out, as many sheets of paper as possible are transported per unit time in order to improve productivity; however, here, after one sheet of paper has been transported, transporting is carried out with a longer time interval being provided between each sheet of paper compared to when image forming is carried out. This is because, once the toner on the heating roller has been transferred from the heating roller to the paper, providing time for the toner to once again transfer from the cleaning roller to the heating roller before the next sheet of paper is transported results in fewer sheets of paper being used to transfer the same amount of toner to the paper. The time interval provided between sheets of paper when image forming is carried out corresponds to an example of a first time interval in the present disclosure, and the time interval provided between sheets of paper in the discharge mode corresponds to an example of a second time interval in the present disclosure.

In this way, once a sufficient amount of toner has been transferred to the paper, the heating of the heating roller is stopped, and a cool-down is implemented until the heating roller has returned to the standby temperature. Here, paper passes through the fixing device 80 at time t2 in the cool-down period. When paper is fed, heat is absorbed by the paper, and the cool-down period may be shortened as indicated by the dashed line a" in FIG. 6. Toner that remains on the heating roller immediately prior to the cool-down regains cohesion due to the cool-down, is recovered from the heating roller, and returns to the cleaning roller and also the support roller.

Figure 7:
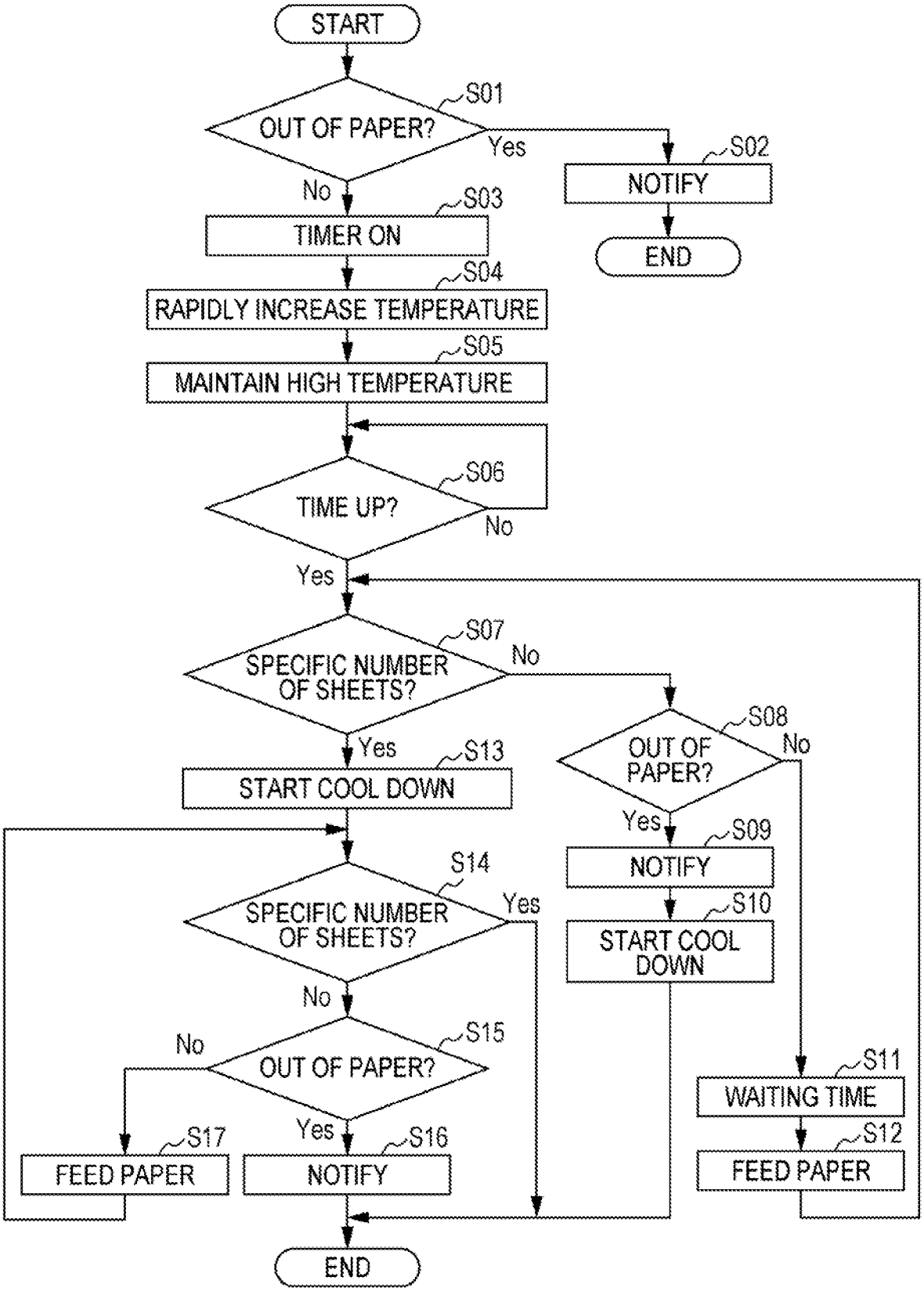
FIG. 7 is a drawing depicting a flowchart representing a control operation carried out by a controller in the discharge mode.

FIG. 7 is a drawing depicting a flowchart representing a control operation carried out by the controller in the discharge mode.

In the present exemplary embodiment, the discharge mode is executed when an instruction is received from a user operating the UI 91 (see FIG. 1). The user instructs the discharge mode to be executed when concerned about staining on paper having an image formed thereon.

When execution of the discharge mode is started, first, the empty state detection sensor 93 (see FIG. 1) detects whether or not paper P is housed in the paper tray 21 (step S01). In a case where the paper tray 21 is empty, executing the discharge mode is not only meaningless but also a waste of energy, and therefore it is notified on the screen of the UI 91 that the paper tray 21 is empty (step S02), and the operation ends there.

When it is understood that there is paper in the paper tray 21 in step S01, a timer is set to on (step S03), and an increase in the temperature of the heating roller 81 is started. This timer is for measuring the time until is paper is fed. When the temperature of the heating roller 81 is increased, as mentioned above, first, an amount of heat is imparted that is sufficient to reach a temperature that is even higher than the discharge temperature if continually imparted (step S04), and midway, the amount of heat imparted is switched to an amount of heat that is sufficient to eventually reach the discharge temperature and that discharge temperature is maintained (step S05). Then, the operation is paused until the timer completes (step S06), and then paper is passed through the fixing device 80. The operation being paused until the timer completes is to wait for the toner to melt and adhere to the heating roller 81, as previously mentioned.

When the paper is passed, first, it is determined whether or not a specific number of sheets of paper (five, for example) have already passed through (step S07). When the specific number of sheets of paper have not yet passed through, it is determined whether or not the paper has run out (the paper tray 21 is empty) (step S08). This is because it is possible for the paper to have run out midway even if the specific number of sheets of paper have not yet passed through. In the case where the paper has run out, a notification is issued stating that a transition will be made to a cool-down due to the paper running out, by means of a display on the screen of the UI 91 (step S09), the cool-down is started (step S10), and the processing of the discharge mode ends.

In step S08, if it is determined that the paper has not run out, the operation is paused for a predetermined waiting time to provide a time interval between each sheet of paper (step S11), and thereafter one sheet of paper is fed (step S12).

After steps S07 to S12 have been repeated for a specific number of sheets, if it is determined in step S07 that a specific number of sheets have been fed, a cool-down is started (step S13). In this exemplary embodiment, paper is also fed during the cool-down period. Here, first, after the cool-down has been started, it is determined whether or not a specific number of sheets of paper (two, for example) have been fed (step S14). When the specific number of sheets of paper have not yet been fed, next, it is determined whether or not the paper has run out (step S15). In the case where the paper has run out, a notification is issued stating that it will take time to carry out the cool-down due to the paper running out, by means of a display on the screen of the UI 91 (step S16), and the processing of the discharge mode ends. In step S15, if it is determined that the paper has not run out, one sheet of paper is fed (step S17), and processing returns to step S14. If it is determined in step S14 that the specific number of sheets have been fed, the processing of the discharge mode ends.

A first exemplary embodiment of the present disclosure has been described hereinabove, and a second exemplary embodiment of the present disclosure will be described hereinafter.

Figure 8A:
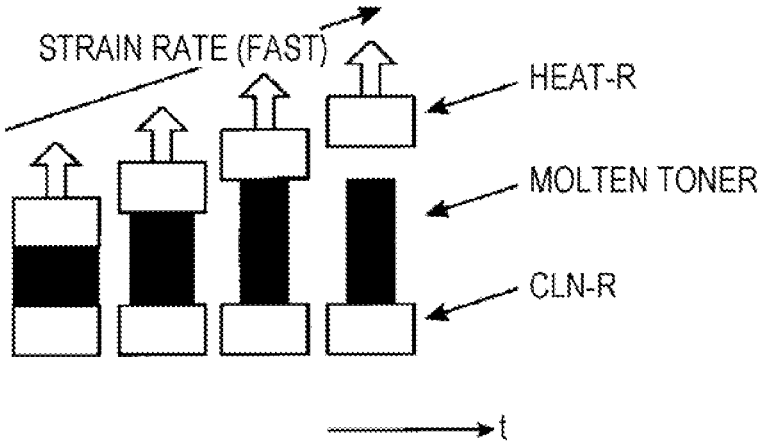
FIGS. 8A and 8B are explanatory diagrams of differences in the behavior of toner caused by differences in strain rate.

FIGS. 8A and B are explanatory diagrams of differences in the behavior of toner caused by differences in the strain rate.

Molten toner is a viscoelastic body, and the behavior thereof may differ depending on the strain rate. Here, the strain rate refers to the speed of deformation (strain) when the molten toner is stretched. When the toner layers are thick and the stretching speeds are the same, a thinner toner layer results in a higher strain rate. When the toner layers have the same thickness, a higher stretching speed results in a higher strain rate.

When molten toner sandwiched between the heating roller and the cleaning roller passes through a nip area in which the heating roller and the cleaning roller are in contact, the molten toner is stretched while being adhered to both the heating roller and the cleaning roller. At such time, if the rotation speed of the heating roller and so forth is high, the molten toner is stretched at a high strain rate.

FIG. 8A depicts the behavior when the molten toner is stretched at a high strain rate due to a high rotation speed of the heating roller and so forth. As depicted in FIG. 8A, when molten toner is stretched at a high strain rate, the molten toner exhibits a strong tendency to separate from the heating roller and remain adhered to the cleaning roller.

Figure 8B:
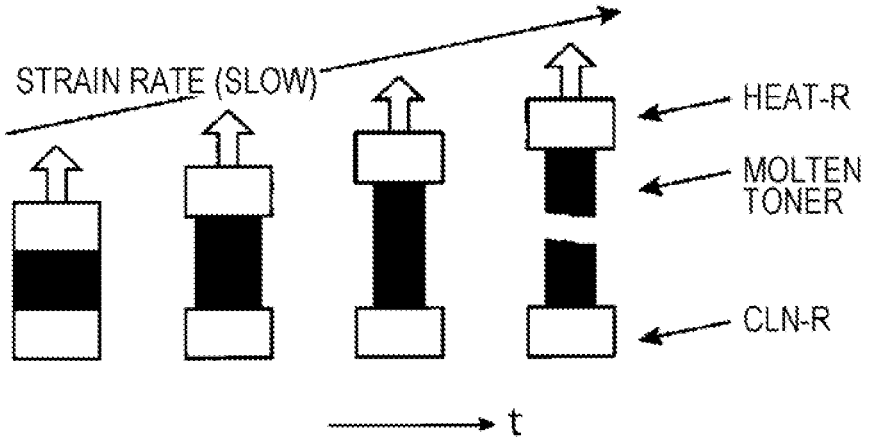

Furthermore, FIG. 8B depicts the behavior when the heating roller and so forth are rotated slowly and as a result the molten toner is stretched at a low strain rate. As depicted in FIG. 8B, when the strain rate is low, the molten toner is likely to break and be adhered also to the heating roller.

In the second exemplary embodiment, using this phenomenon, the temperature increase of the heating roller is limited to the fixing temperature also in the discharge mode, and instead the rotation speed of the heating roller and so forth is reduced compared to when image forming is carried out, thereby causing the molten toner to be discharged to the heating roller. In other words, in the discharge mode, the rotation speed of the heating roller and so forth is reduced, and accordingly paper is transported slowly. Control with which the paper is transported slowly corresponds to an example of fourth control in the present disclosure. This second exemplary embodiment may also be applied to a fixing device that is not capable of a temperature increase to a discharge temperature that is higher than a fixing temperature, such as that depicted in FIG. 6.

FIG. 7 depicts a flowchart of the processing for the discharge mode in the first exemplary embodiment; however, here, the processing for the discharge mode in the second exemplary embodiment will be described with reference to the flowchart of FIG. 7 once again. However, descriptions of processing that is the same as that in the first exemplary embodiment will be omitted.

In the case of the second exemplary embodiment, in steps S04 and S05 in FIG. 7, the temperature is increased to the fixing temperature, and the fixing temperature is maintained. Furthermore, in the paper feeding in steps S12 and S17, paper is transported and fed through the fixing device at a slower speed compared to when image forming is carried out.

The other steps in the second exemplary embodiment are similar to those of the first exemplary embodiment, and duplicate descriptions are omitted.

It should be noted that the first exemplary embodiment and the second exemplary embodiment may be combined as a third exemplary embodiment. In other words, in the third exemplary embodiment, similar to the first exemplary embodiment, the temperature of the heating roller is increased to the discharge temperature which is higher than the fixing temperature, and in the paper feeding in steps S12 and S17, paper is transported and fed through the fixing device at a slower speed compared to when image forming is carried out, similar to the second exemplary embodiment. According to the third exemplary embodiment, toner may be made to adhere to paper even more efficiently compared to either of the first exemplary embodiment and the second exemplary embodiment.

In the exemplary embodiments, descriptions have been given using the example of a fixing device composed of a combination of a heating roller and a pressure belt. However, the present disclosure is not limited to a fixing device composed of a combination of a heating roller and a pressure belt. The present disclosure may be applied to various types of fixing devices such as a combination of a heating roller and a pressure roller, a combination of a heating belt and a pressure roller, or a combination of a heating belt and a pressure belt.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a fixer comprising:

a heater that is configured to sandwich and heat transported paper comprising a toner image; and a remover configured to remove toner from the heater; and a controller configured to execute first control with which the paper comprising the toner image is fed to the heater in a state where a temperature of the heater has been increased to a first temperature, wherein the controller is configured to execute second control with which paper without any toner image is fed to the heater in a state where the temperature of the heater has been increased to a second temperature that is higher than the first temperature, wherein the controller is configured to, in executing the first control, transport a plurality of sheets of paper with a first time interval being provided between adjacent sheets of paper, and wherein the controller is configured to, in executing the second control, transport a plurality of sheets of paper with a second time interval that is longer than the first time interval being provided between adjacent sheets of paper.

2. The fixing device according to claim 1, wherein the controller is configured to, when starting to execute the second control, set an amount of heat imparted to the heater per unit time, to a first amount of heat sufficient for increasing the temperature of the heater to a third temperature that is higher than the second temperature, and midway, alter the amount of heat imparted to the heater per unit time, to a second amount of heat which is lower than the first amount of heat and with which the heater is adjusted to the second temperature.

3. The fixing device according to claim 1, wherein the controller is configured to, in executing the second control, seta cooling period during which the heater is cooled, after a predetermined specific number of sheets of paper have been fed to the heater, or, if the paper runs out prior to reaching the specific number of sheets of paper, then set the cooling period after at a time at which the paper runs out.

4. The fixing device according to claim 2, wherein the controller is configured to, in executing the second control, seta cooling period during which the heater is cooled, after a predetermined specific number of sheets of paper have been fed to the heater, or, if the paper runs out prior to reaching the specific number of sheets of paper, then set the cooling period at a time at which the paper runs out.

5. The fixing device according to claim 3, wherein the controller is configured to, in executing the second control, and if the paper has not run out, then feed paper to the heater also during the cooling period.

6. The fixing device according to claim 4, wherein the controller is configured to, in executing the second control, feed paper to the heater also during the cooling period.

7. The fixing device according to claim 1, wherein the controller is configured to, if paper has run out prior to the second control starting, then refrain from starting the second control.

8. A fixing device comprising:

a fixer comprising:

a heater that is configured to sandwich and heat transported paper comprising a toner image; and a remover configured to remove toner from the heater; and a controller configured to execute first control with which the paper comprising the toner image is fed to the heater in a state where a temperature of the heater has been increased to a first temperature, wherein the controller is configured to execute second control with which paper without any toner image is fed to the heater in a state where the temperature of the heater has been increased to a second temperature that is higher than the first temperature, and wherein the controller is configured to, when starting to execute the second control, set an amount of heat imparted to the heater per unit time, to a first amount of heat sufficient for increasing the temperature of the heater to a third temperature that is higher than the second temperature, and midway, alter the amount of heat imparted to the heater per unit time, to a second amount of heat which is lower than the first amount of heat and with which the heater is adjusted to the second temperature.

9. The fixing device according to claim 8, wherein the controller is configured to, in executing the second control, seta cooling period during which the heater is cooled, after a predetermined specific number of sheets of paper have been fed to the heater, or, if the paper runs out prior to reaching the specific number of sheets of paper, then set the cooling period at a time at which the paper runs out.

10. The fixing device according to claim 9, wherein the controller is configured to, in executing the second control, and if the paper has not run out, then feed paper to the heater also during the cooling period.

11. A fixing device comprising:

a fixer comprising:

a heater that is configured to sandwich and heat transported paper comprising a toner image; and a remover configured to remove toner from the heater; and a controller configured to execute first control with which the paper comprising the toner image is fed to the heater at a first transport speed in a state where a temperature of the heater has been increased to a first temperature, wherein the controller is configured to execute second control with which paper without any toner image is fed to the heater at a second transport speed that is slower than the first transport speed in a state where the temperature of the heater has been increased to the first temperature, wherein the controller is configured to, in executing the first control, transport a plurality of sheets of paper with a first time interval being provided between adjacent sheets of paper, and wherein the controller is configured to, in executing the second control, transport a plurality of sheets of paper with a second time interval that is longer than the first time interval being provided between adjacent sheets of paper.

12. An image forming device comprising:

an image former configured to form a toner image on paper;

a fixer comprising:

a heater that is configured to sandwich and heat the paper, the paper being transported, and the paper comprising the toner image; and a remover configured to remove toner from the heater; and a controller configured to execute first control with which the paper comprising the toner image is fed to the heater in a state where a temperature of the heater has been increased to a first temperature, wherein the controller is configured to execute second control with which paper without any toner image is fed to the heater in a state where the temperature of the heater has been increased to a second temperature that is higher than the first temperature, wherein the controller is configured to, in executing the first control, transport a plurality of sheets of paper with a first time interval being provided between adjacent sheets of paper, and wherein the controller is configured to, in executing the second control, transport a plurality of sheets of paper with a second time interval that is longer than the first time interval being provided between adjacent sheets of paper.

* * * * *